US006179525B1

(12) United States Patent
Gruhn et al.

(10) Patent No.: US 6,179,525 B1
(45) Date of Patent: Jan. 30, 2001

(54) FLOATING DOCK SECTION

(75) Inventors: Ryan B. Gruhn, Atlantic; Michael E. Irlmeier, Adair; Kurt L. McCuen, Casey, all of IA (US)

(73) Assignee: Schafer Systems Inc., Adair, IA (US)

( * ) Notice: Under 35 U.S.C. 154(b), the term of this patent shall be extended for 0 days.

(21) Appl. No.: 09/309,776

(22) Filed: May 11, 1999

(51) Int. Cl.[7] ..... B63C 3/02; B63B 35/34; B63B 35/38

(52) U.S. Cl. ..... 405/219; 405/218; 114/263; 114/266; 114/267

(58) Field of Search ..... 405/218, 219; 114/266, 267, 263

(56) References Cited

U.S. PATENT DOCUMENTS

| | | | | |
|---|---|---|---|---|
| 3,179,076 | * | 4/1965 | Sheffield | 114/267 |
| 3,777,689 | * | 12/1973 | Olsen et al. | 114/5 F |
| 4,559,891 | * | 12/1985 | Shorter, Jr. | 114/267 |
| 4,655,156 | * | 4/1987 | Svirklys et al. | 114/266 |
| 4,660,495 | * | 4/1987 | Thompson | 114/263 |
| 4,733,626 | * | 3/1988 | Svirklys et al. | 114/267 |
| 4,799,445 | * | 1/1989 | Meriwether | 114/267 |
| 4,928,617 | * | 5/1990 | Meriwether | 114/267 |
| 4,974,538 | * | 12/1990 | Meriwether | 114/267 |
| 5,199,370 | * | 4/1993 | Berquist | 114/267 |
| 5,213,447 | * | 5/1993 | Srock | 405/219 |
| 5,404,825 | * | 4/1995 | McElwain | 114/267 |
| 5,460,114 | * | 10/1995 | McMillan | 114/267 |
| 5,915,325 | * | 6/1999 | Gerber et al. | 114/263 |

* cited by examiner

*Primary Examiner*—Eileen D. Lillis
*Assistant Examiner*—Alexandra K. Pechhold
(74) *Attorney, Agent, or Firm*—G. Brian Pingel

(57) ABSTRACT

A floating dock section that is secure, economical and durable and can be coupled together with a similar type section by a connecting member that fits into a socket of the dock section. Each connecting member has flanges that fit into receiving sockets of two adjacent dock sections to form a dock of a preferred configuration so that the dock sections can be arranged in a plethora of configurations. Modular pieces for end posts and other accessories can be added. The bottom surface of the dock section includes a plurality of rectangularly shaped closely spaced apart troughs that are in a parallel alignment with one another.

7 Claims, 4 Drawing Sheets

17
19
22
24
25
12
15
18
20

12
15
16
19
24
25
17
18
20

36
34
10

10
13
55
36
34
32
30
31

FLOATING DOCK SECTION

BACKGROUND OF THE INVENTION

1. Field of the Invention

The present invention relates to floating docks, and, in particular, to durable polyethylene dock sections that are formed to provide a rigid, strengthened top surface that maintains its shape and provides a superior support and feel for persons walking on the section.

2. Description of the Prior Art

Floating marine docks formed of sections are commonly used as a means of providing access to and mooring for boats or as swimming or fishing platforms. Modular or sectional docks are frequently employed for constructing docks of various sizes and configurations. In the past, Styrofoam has commonly been used as the basis for docking modules. These modules, however, are unstable, cumbersome, hazardous to the environment, and are, therefore, limited in their applications. This creates a need for a buoyant modular dock made almost entirely of molded polyethylene or other environmentally stable materials.

In addition, the apparatus connecting modular docks together must be secure enough and strong enough to withstand high stress. Some prior art docks have secured floating dock sections together with joists, locking pins, mounting plates, springs and other fasteners, but each suffers from its own disadvantages. U.S. Pat. No. 5,281,055 utilizes rubber connectors that fit into sockets positioned at the top and bottom edges of the dock sections. To maintain flotation of the '055 patent dock sections if they are damaged so that they become filled with water, the sections are formed with a plurality of frustoconically shaped pylons that trap air for assisting in supporting the sections in the water.

The lateral and vertical movement that results from the action of wind and waves against floating docks puts considerable stress on the connecting apparatus which must be highly durable. Furthermore, the top surface of the dock sections must be supported to present a firm feel to a user. In addition, the amount of flexing of the top surface should be minimized to reduce the potential of stress cracking. A need exists, therefore, for a modular floating dock with a high strength connecting apparatus that is durable enough to be used in a variety of settings.

SUMMARY OF THE INVENTION

The present invention provides a durable modular floating dock section that can be utilized to form a variety of dock configurations for boating, swimming, fishing, and various other functions. The individual dock sections include a plurality of closely spaced apart parallel aligned troughs that are arranged in a transverse relationship to the length of the sections. The sections can be connected together by using a connecting member to form a variety of design configurations. The connecting member is comprised of two flanges that each fit into a complementary receiving socket on two adjacent dock sections. The connecting member and dock sections can be further secured together by a bolt and nut. Other modular pieces, such as a pole bracket, can be connected to the dock sections in a similar fashion.

DETAILED DESCRIPTION OF THE PREFERRED EMBODIMENT

Figures 1, 2:
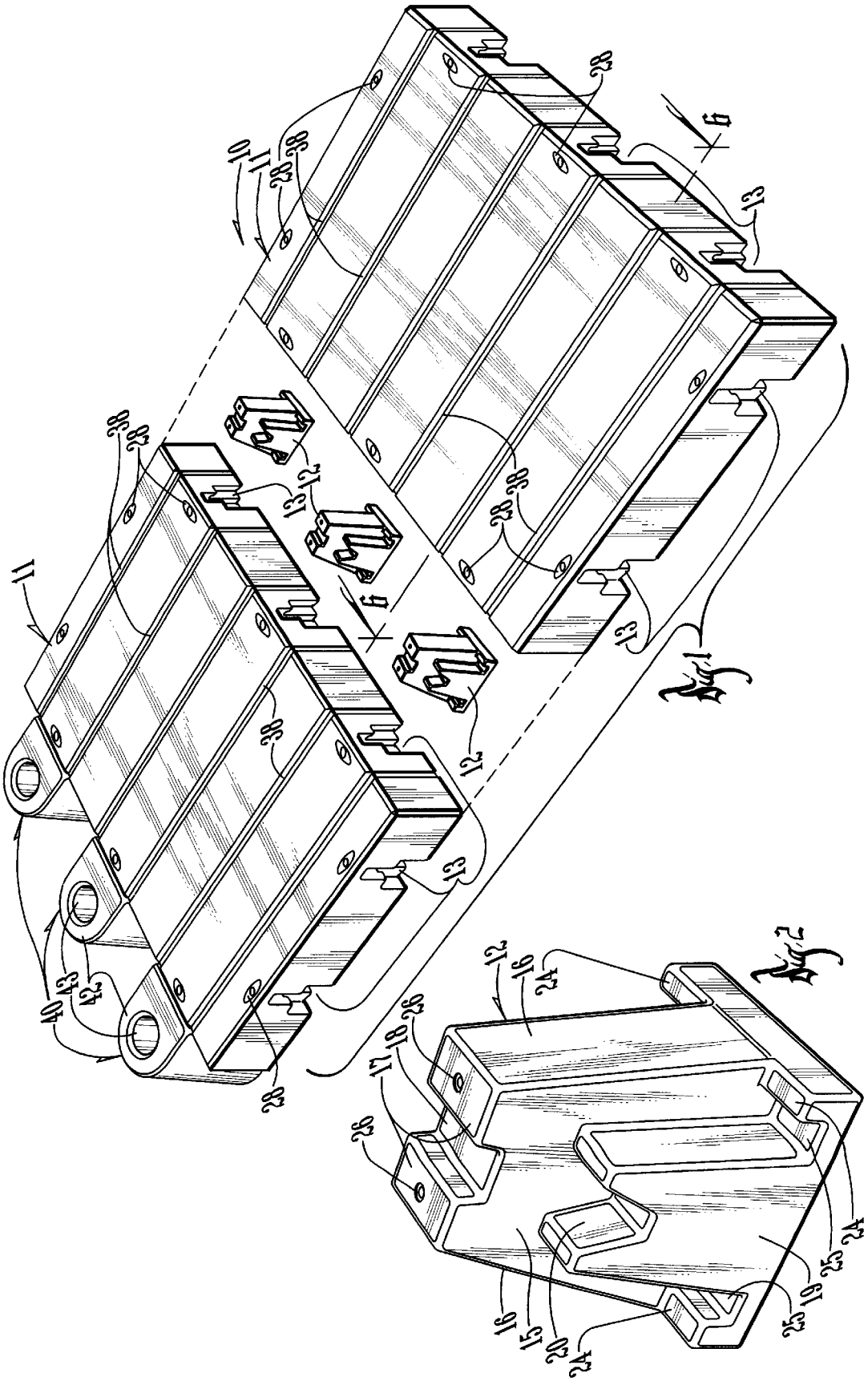
FIG. 1 is a perspective top view of a preferred embodiment of the components of a floating dock of the present invention formed of two dock sections and three connecting members that are used to secure the dock sections together.
FIG. 2 is a perspective view of a preferred embodiment of one of the connecting members shown in FIG. 1.

The present invention involves a floating dock 10, as shown in FIG. 1, comprised of at least two dock sections 11 of the present invention. Preferably, the sections 11 are connected together by three connecting members 12 to provide a wobble free connection therebetween. However, it should be recognized by those skilled in the art that a single connecting member 12 could be used where conditions allow. Each dock section 11 is, in the preferred embodiment, a one piece molded body and may be of any shape, although a square or rectangular shape is preferred. The dimensions of each dock section 11 can vary depending upon its intended location and design. In the preferred embodiment, each section 11 is generally rectangular in shape, forty-five inches long, thirty inches wide, ten inches high and weighs approximately fifty pounds.

The dock sections 11 can be constructed of any suitable material, but preferably they are made of molded polyethylene, because it possesses strength and durability, is resistant to gas, oil and other contaminants and is also stable on the water. Each dock section 11 is generally hollow. The wall thickness of the dock sections 11 can vary, but a range of one-eighth inch in protected areas to three-eighth inch in exposed areas like outside corners, and with a wall thickness on the top (walking) surface of approximately one-fourth inch, is preferred.

Spaced about the perimeter of the dock sections 11 are a plurality of receiving sockets 13. It is preferred that the sockets 13 are uniformly spaced along the sides and ends of each dock section 11 so that two sections can be connected together in a variety of ways. The dock sections 11 can have any appropriate number of sockets 13, although in the preferred embodiment, three such sockets are located along the long side of the dock section 11 and two sockets are located along the short side.

Figure 4:
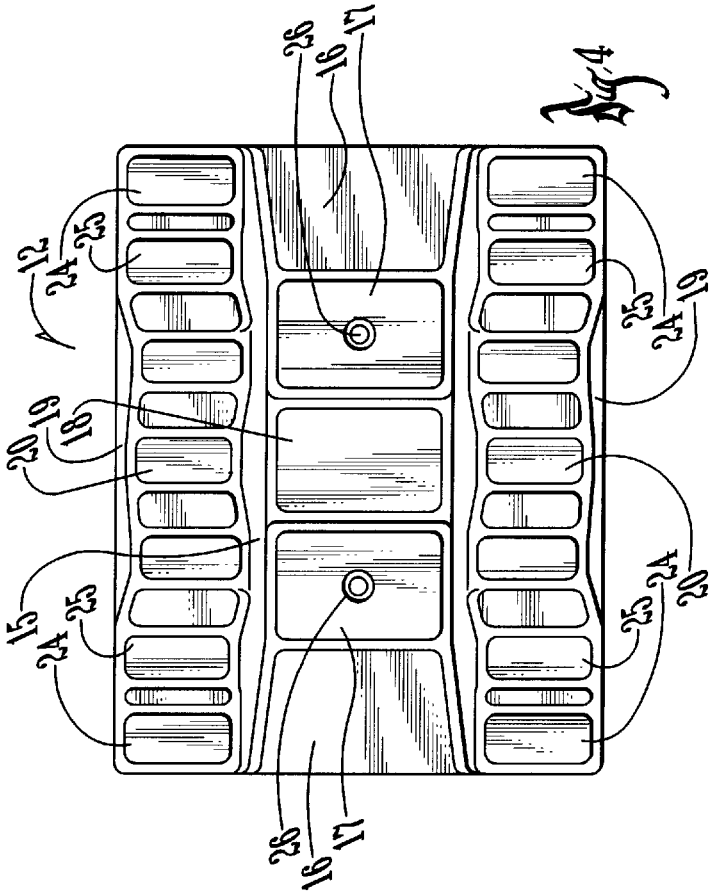
FIG. 4 is a top view of the connecting member of FIG. 4.
Figure 3:
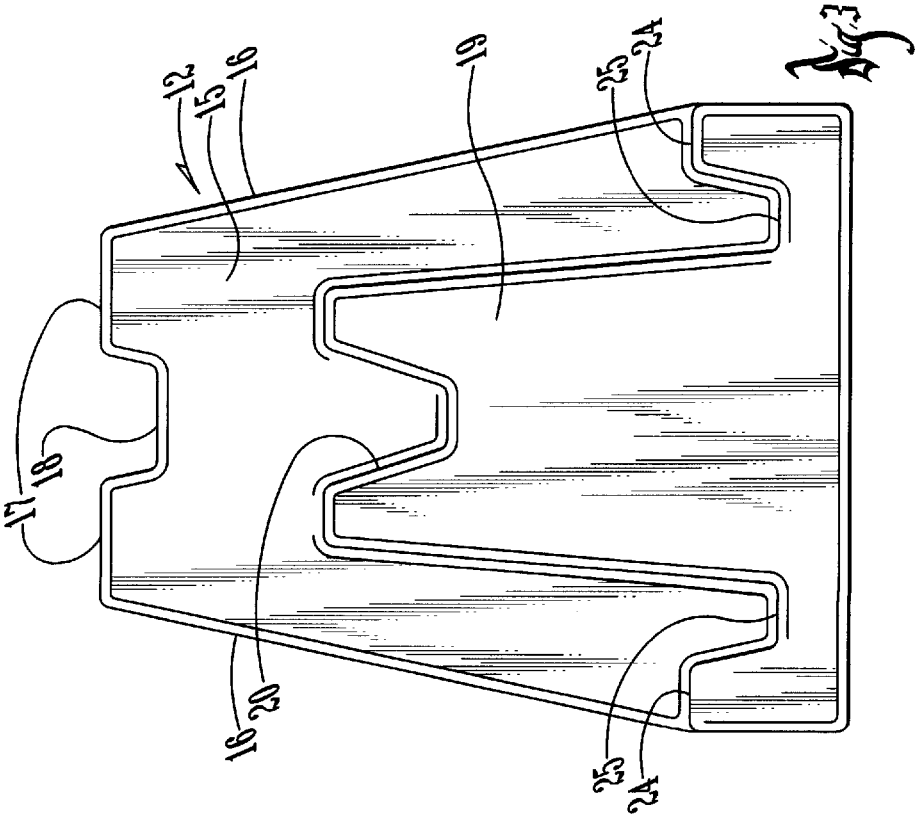
FIG. 3 is a side view of the connecting member of FIG. 4.

Referring now to FIGS. 2, 3 and 4 the connecting members 12 are used to attach the dock sections 11 together and are complimentary in shape to the sockets 13. Each connecting member 12 has a body 15 with at least two flanges 16, and each flange 16 is received in and interlocks with a receiving socket 13. Each flange 16 has an inwardly tapered post section 17 adjacent to which is a top recess 18. In the preferred embodiment, the body 15 further includes two side members 19 that are somewhat similar in shape to the flanges 16 and extend from opposite sides thereof. Each side member 19 is notched to form a recess 20, and the flanges 16 have lower ledge portions 24 that are spaced from the side members 19 to form bottom recesses 25.

In the preferred embodiment, the top of each post section 17 contains a threaded bore 26 molded therein. Securing means, such as a bolt (not shown), can then be positioned through holes 28 in the top of the dock section 10 and secured in the bores 26. This serves to semi-permanently secure the dock section 10 and its associated connecting member 12 together.

Figure 5:
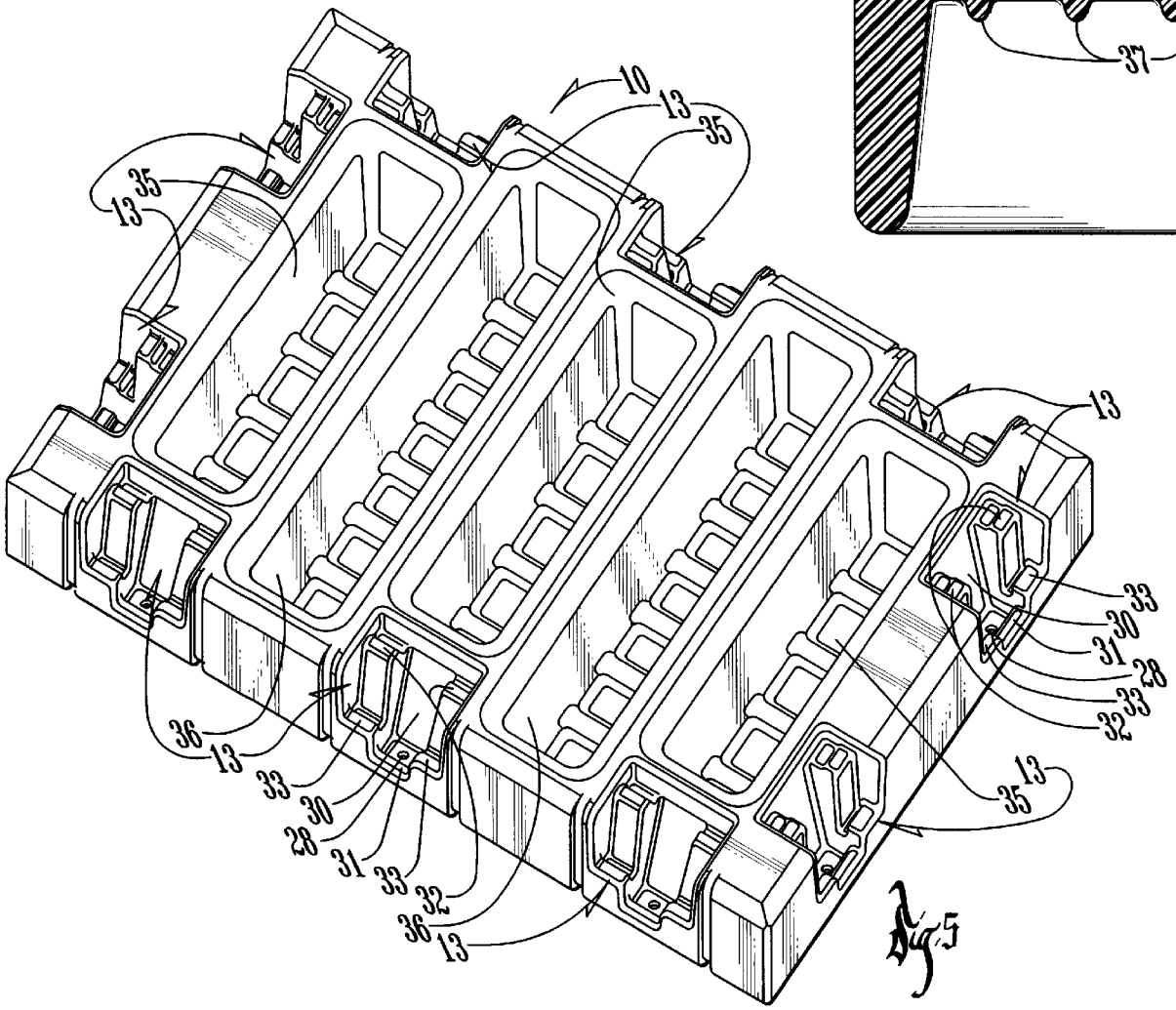
FIG. 5 is a perspective bottom view of one of the dock sections of FIG. 1.

As shown best in FIG. 5, the sockets 13 each comprise a central, vertically oriented, tapered recessed portion 30 that is complementary in shape to one-half of a connecting member 12, as described below so that they fit together in an interlocking relationship. At the top of each socket 13 is a top overhang 31 intended to fit into the top recess 18 of one of the connecting members 12. In the preferred embodiment, the sockets 13 further comprise two bottom overhangs 32 that interlock with the bottom recesses 25 of one of the connecting members 12, and two side overhangs 33 that interlock with the recesses 20 in the side members 19 to thereby provide an efficient, effective and durable means for interlocking the dock sections 10 together.

To increase the structural strength of the dock sections 10, a number of parallel aligned troughs 35 and 36 (FIG. 5) of a generally rectangular shape extend from the bottom upward toward the top of each dock section 10. These troughs 35 and 36 each define a cavity in the dock section 10, so that air is captured within the trough 35 when the dock section 10 is positioned in the water. The sides of the troughs 35 and 36 also provide structural support against downward or lateral pressure applied to the dock sections 11 and minimize flexing of the top surface of the sections 11. In the preferred embodiment, the troughs 35 and 36 comprise a total of five and extend along the bottom of the dock section 10.

Figure 6:
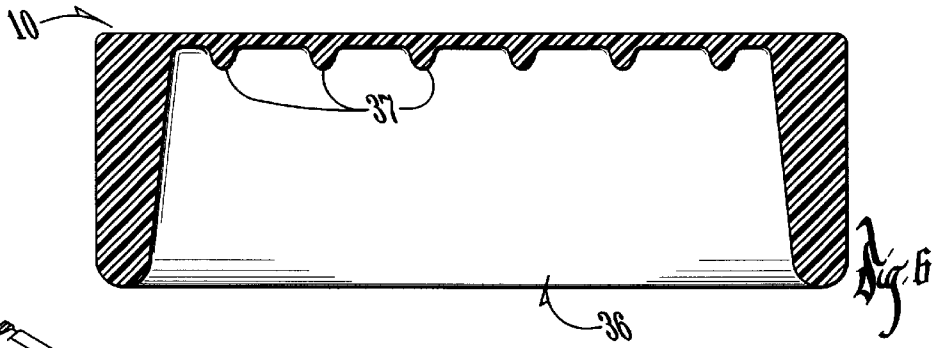
FIG. 6 is a cross sectional view of one of the dock sections of FIG. 1 taken along the line 6—6 of FIG. 1.

There are three of the troughs 35, which are shorter than the troughs 36 and extend between the receiving sockets 13 on their respective sides. There are two of the long troughs 36 that are unencumbered by the receiving sockets 13 so as to extend from side to side. In the preferred embodiment, the short troughs 35 are approximately nineteen inches long, four inches wide and nine and one-half inches deep, and the long troughs 36 are approximately twenty-five inches long, four inches wide and nine and one-half inches deep. Accordingly, a majority of the bottom of the dock sections 11 is formed from the troughs 35 and 36. As shown by FIGS. 5 and 6, the ceilings of the troughs 35 and 36 are formed with transverse ribs 37 to improve the flow of plastic during molding and productability of the sections 11. The top of each dock section 11 is formed with a plurality of parallel aligned, spaced apart elongated indentations 38 (see FIG. 1) that span each section 11, which indentations are located in an alignment between each of the troughs 35 and 36 to further minimize the amount of flexing of the dock section top surface and thereby reduce the potential of stress cracking.

Figure 8:
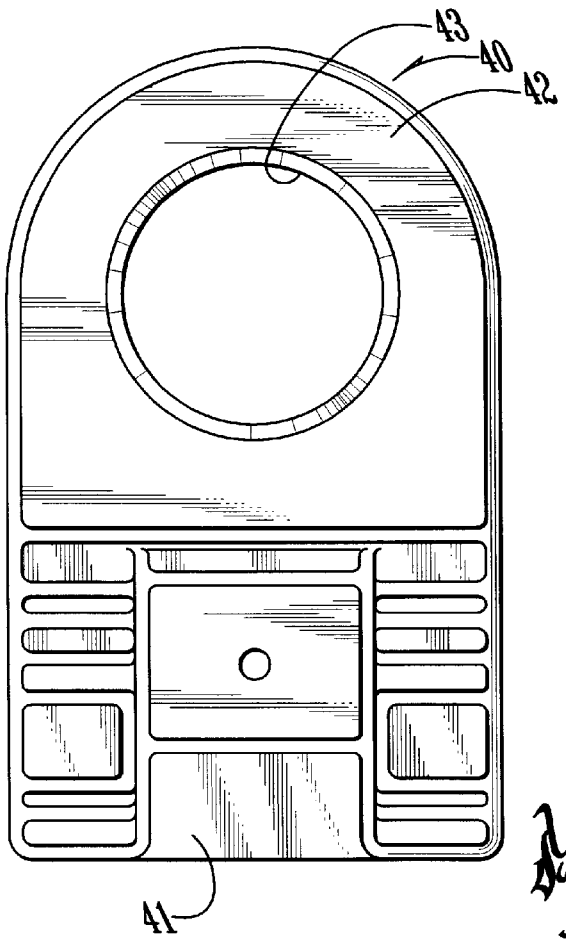
FIG. 8 is a top view of the embodiment of FIG. 7.
Figure 7:
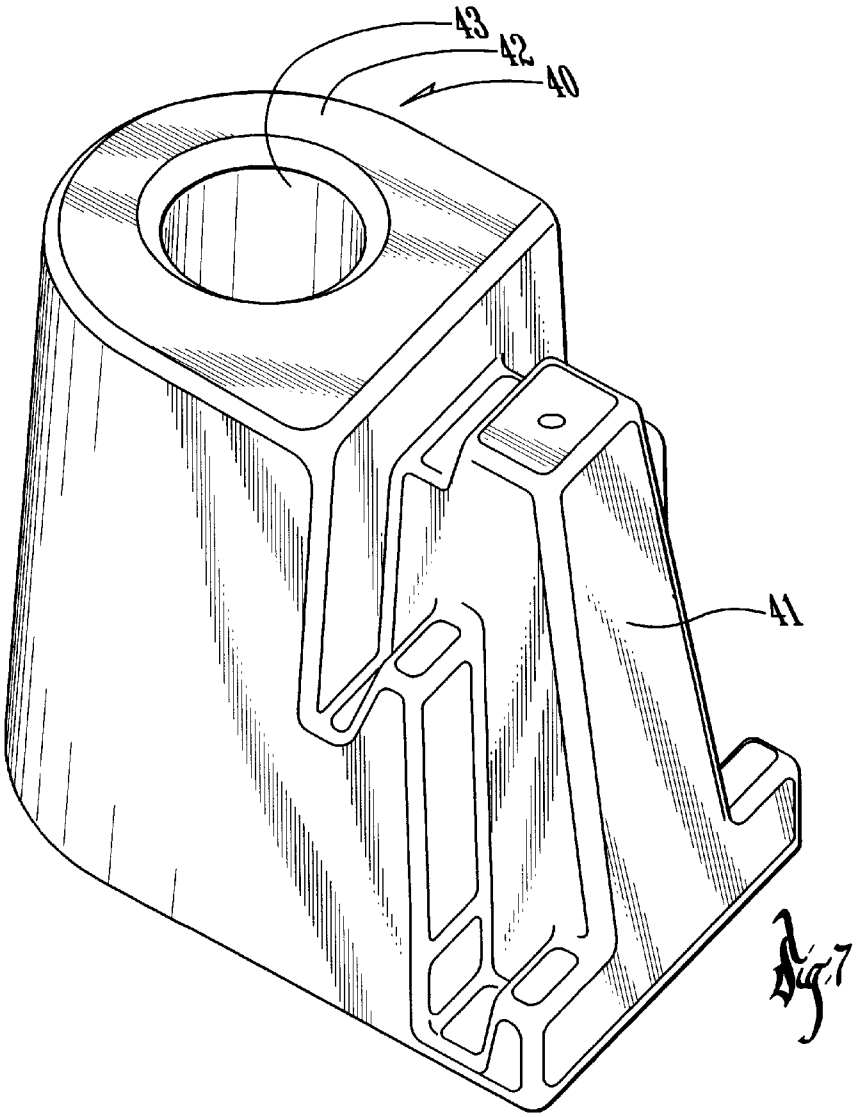
FIG. 7 is a perspective view of a pole bracket that can be attached to a dock section.

To stabilize the dock 10, it is highly preferable to utilize one or more stabilizing poles (not shown) to brace the floating dock. Each stabilizing pole can be secured to the dock by the use of a pole bracket 40 as shown in FIGS. 7 and 8. Each of the members 40 is comprised of a flange section 41 and a pole section 42 that contains a pole hole 43. The flange section 41 is similar in shape to the flanges 16. Thus, each pole bracket 40 can be secured in one of the receiving sockets 13. Other types of attachments and accessories, such as gangways, ladders, boat moorings, and floating dry docks for watercraft (all not shown) can also be attached to the dock by the use of members that interlock with the receiving sockets 13.

In application, the dock sections 10 are connected together with the use of connecting members 12 into a desired configuration. Any dock section 11 can easily be secured to the shore through the use of arms, cables, gang planks or other means. The present invention thus provides a complete floating dock that does not require additional elements for use, such as boat bumpers or wood planking, or additional parts for assembly. The polyethylene dock sections 11 are durable, stable and have a long life. The shape of the flanges 16 and receiving sockets 13 ensure that the dock sections 11 will remain securely attached by the connecting members 12 so that the dock sections 11 will not separate during use. The connecting members 12 also result in a tight fit and a very small gap between the dock sections 11, and this increases the ease and safety of walking on the dock 10.

While a preferred embodiment of the present invention has been described, it should be understood that various changes, adaptations and modifications may be made therein without departing from the spirit of the invention and the scope of the appended claims.

What is claimed is:

1. A hollow floating dock section that forms part of a floating dock and comprises:

a) a top surface;

b) a pair of end walls;

c) a pair of sidewalls;

d) a bottom surface that is formed with a plurality of recessed troughs that are in parallel alignment with one another and extend upwardly toward said top surface to terminate in a ceiling that is formed with traverse spaced apart ribs and is closely adjacent to said top surface; and e) wherein said top surface is formed with a plurality of parallel aligned, spaced apart elongated indentations that extend between said end walls aligned between the troughs of said bottom surface.

2. A dock section as recited in claim 1, wherein said troughs alternately include long troughs and short troughs.

3. A dock section as recited in claim 1, wherein said section is rectangularly shaped and is adapted to be fastened to another similarly shaped section to form a floating dock.

4. A dock section as recited in claim 1, wherein said section has at least five troughs.

5. A dock section as recited in claim 3, wherein said troughs have ends that are adjacent to said end walls.

6. A dock section as recited in claim 5, wherein said end walls of said section have spaced apart receiving sockets, with the receiving sockets of one end wall in alignment with the receiving sockets of the other sidewall to form an aligned pair of sockets.

7. A dock section as recited in claim 6, wherein one of said troughs is in alignment with one of said aligned pair of sockets.

* * * * *